US007082794B2

(12) United States Patent
Shen et al.

(10) Patent No.: US 7,082,794 B2
(45) Date of Patent: Aug. 1, 2006

(54) MORTISE LOCK

(75) Inventors: Mu-Lin Shen, Tainan (TW); Roger Tiem, Tainan Shiann (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 164 days.

(21) Appl. No.: 10/867,118

(22) Filed: Jun. 14, 2004

(65) Prior Publication Data

US 2005/0274163 A1 Dec. 15, 2005

(51) Int. Cl.
*E05B 13/10* (2006.01)
*E05B 63/00* (2006.01)

(52) U.S. Cl. ..... 70/224; 70/422; 292/169.22; 292/336.3; 292/352; 292/358; 292/DIG. 61

(58) Field of Classification Search ..... 70/210, 70/224, 422, 215–217; 292/352, 353, 355, 292/336.3, 169.22, DIG. 27, DIG. 61, 358
See application file for complete search history.

(56) References Cited

U.S. PATENT DOCUMENTS

| | | | | | |
|---|---|---|---|---|---|
| 1,308,521 | A * | 7/1919 | Butter | 70/311 |
| 2,063,708 | A * | 12/1936 | Swilens | 70/134 |
| 2,138,856 | A * | 12/1938 | Harp | 70/216 |
| 2,609,679 | A * | 9/1952 | Bremer et al. | 70/1.5 |
| 2,787,154 | A * | 4/1957 | Wesberry | 70/118 |
| 2,825,220 | A * | 3/1958 | Glass | 70/224 |
| 3,024,055 | A * | 3/1962 | Novarino | 292/169.18 |
| 3,233,439 | A * | 2/1966 | Papas | 70/152 |
| 4,424,691 | A * | 1/1984 | Foshee | 70/224 |
| 4,428,212 | A * | 1/1984 | Best et al. | 70/224 |
| 4,428,570 | A * | 1/1984 | Foshee et al. | 267/164 |
| 4,471,984 | A * | 9/1984 | Bellantuono | 292/350 |
| 4,667,994 | A * | 5/1987 | Foshee | 292/358 |
| 4,746,155 | A * | 5/1988 | Hart | 292/351 |
| 4,876,866 | A * | 10/1989 | Fleming et al. | 70/379 R |
| 5,029,914 | A * | 7/1991 | Hankel | 292/336.3 |
| 5,046,772 | A * | 9/1991 | Su | 292/336.5 |
| 5,177,987 | A * | 1/1993 | Shen | 70/224 |
| 5,794,472 | A * | 8/1998 | Kester et al. | 70/472 |
| 5,887,465 | A * | 3/1999 | Shen | 70/224 |
| 6,427,505 | B1 * | 8/2002 | Imedio Ocana | 70/422 |
| 2005/0126236 | A1 * | 6/2005 | Romero | 70/224 |

* cited by examiner

*Primary Examiner*—Lloyd A. Gall
(74) *Attorney, Agent, or Firm*—Alan D. Kamrath; Nikolai & Mersereau, P.A.

(57) ABSTRACT

A mortise lock includes a chassis mounted in a mounting hole of a door and an outside handle assembly mounted to a side of the chassis. The outside handle assembly includes an outside spindle having a first end partially received in the chassis and operably connected to at least one bolt of the chassis such that rotation of the outside spindle causes retraction of the bolt. The first end of the outside spindle includes a perimeter groove, forming a fragile portion. An outside handle includes an end securely connected to a second end of the outside spindle to turn therewith. The fragile portion of the outside spindle is broken when an excessive force is applied to the outside handle. Thus, unauthorized opening of the door by forcibly turning the outside handle is prevented. Further, the mortise lock can be easily installed, and the cost of the mortise lock is cut.

16 Claims, 13 Drawing Sheets

MORTISE LOCK

BACKGROUND OF THE INVENTION

1. Field of the Invention

The present invention relates to a mortise lock. In particular, the present invention relates to a mortise lock including two handles that can be returned to their original horizontal position.

2. Description of the Related Art

FIG. 1 of the drawings illustrates a conventional mortise lock comprising an inside handle assembly 1, an outside handle assembly 2, and a chassis 3 between the inside handle assembly 1 and the outside handle assembly 2. The chassis 3 is mounted in a mounting hole (not shown) of a door (not shown) and includes a plurality of bolts 31 and a mechanism for operating the bolts 31. The inside handle assembly 1 includes an inside handle 11 and an inside spindle 12 having an end received in a spindle hub 32*b* of the chassis 3. The outside handle assembly 2 includes an outside handle 21 and an outside spindle 22 having an end received in another spindle hub (not shown) of the chassis 3 that is aligned with the spindle hub 32*b*. When either handle 11, 21 is turned, the associated spindle 12, 22 and the associated spindle hub of the chassis 3 are turned to retract the bolts 31.

The inside handle assembly 1 further includes an inside spring package 15 mounted around the inside spindle 12 for returning the inside handle 11 to its original position (generally horizontal) when the inside handle 11 is turned and then released. The inside spring package 15 includes a spring seat 151, a collar 152 having a square hole 155 through which the inside spindle 12 extends, a spring 153 mounted to the spring seat 151, and a lid 154 for housing the spring 153 and the collar 152. When the inside handle 11 is turned, the inside spindle 12 and the collar 152 are turned. When the inside handle 11 is released, the inside handle 11 is returned to its original horizontal position under the action of the spring 153. The inner handle 11 further includes a threaded section 111 on an end thereof to which a sleeve 13 is mounted. The sleeve 13 includes an inner threading 131 for threadedly engaging with a stud 161 projecting from a side of a connecting member 16 that provides a support for two screws 17 that are engaged with two posts 27 of the outer handle assembly 2. An inside rose 14 is provided to house the inside spring package 15 and associated elements. Similarly, the outside handle assembly 2 further includes an outside spring package 25, a sleeve 23, a connecting member (not shown), and an outside rose 24 for returning the outside handle 21 to its horizontal position.

Installation of the sleeves 13, 23 to the end of the associated handles 11, 21 is troublesome. Further, the sleeves 13, 23 may be undesiredly turned together with the handles 11, 21 due to friction, causing loosening of the handles 11, 21. Further, the elements of the lock are apt to be damaged or permanently deformed by the torque applied to the handles 11, 21 (especially lever-type handles), adversely affecting retraction of the bolts 31.

Further, the handles 11, 21 are generally made from brass, which is relatively expensive. Processing of the threaded section 111 of the handles 11, 21 and the inner threading 131 of the sleeves 13, 23 is troublesome and expensive. Further, special tools are required for mounting the sleeves 13 and 23.

SUMMARY OF THE INVENTION

In accordance with a first aspect of the present invention, a mortise lock comprises a chassis mounted in a mounting hole of a door and an outside handle assembly mounted to a side of the chassis. The outside handle assembly includes an outside spindle having a first end partially received in the chassis and operably connected to at least one bolt of the chassis such that rotation of the outside spindle causes retraction of the bolt. The first end of the outside spindle includes a perimeter groove, forming a fragile portion. An outside handle includes an end securely connected to a second end of the outside spindle to turn therewith. The fragile portion of the outside spindle is broken when an excessive force is applied to the outside handle. Thus, unauthorized opening of the door by forcibly turning the outside handle is prevented. Also, damage to the inner mechanism of the mortise lock is prevented.

In an embodiment of the invention, the mortise lock further comprises an outside sleeve including a first end securely mounted around a portion of the first end of the outside spindle to turn therewith. A second end of the outside sleeve receives the second end of the outside spindle and is securely connected to the end of the outside handle. The end of the outside handle includes an engaging hole. The outside sleeve includes a longitudinal hole and a longitudinal groove defined in an outer periphery thereof. The outside sleeve further includes a positioning hole and a slot in the outer periphery of the outside sleeve. The slot is communicated with the longitudinal hole and aligned with the engaging hole of the outside handle.

A tenon is mounted in the outside sleeve and includes a first end received in the slot of the outside sleeve and a second end having a notch. The tenon further includes an opening. A substantially U-shaped resilient member is mounted in the outside sleeve and includes a first L-shaped leg pressing against an end edge delimiting the opening of the tenon and a second L-shaped leg extending through the notch of the tenon into the positioning hole of the outside sleeve. The resilient member biases the first end of the tenon into the engaging hole of the outside handle.

The second end of the outside spindle has an inclined surface pressing against an edge delimiting the opening of the tenon. When the outside spindle is pushed outward, the first end of the tenon is disengaged from the engaging hole of the outside handle, allowing removal of the outside handle from the outside sleeve.

Other objectives, advantages, and novel features of the invention will become more apparent from the following detailed description when taken in conjunction with the accompanying drawings.

DETAILED DESCRIPTION OF THE PREFERRED EMBODIMENT

Figure 1:
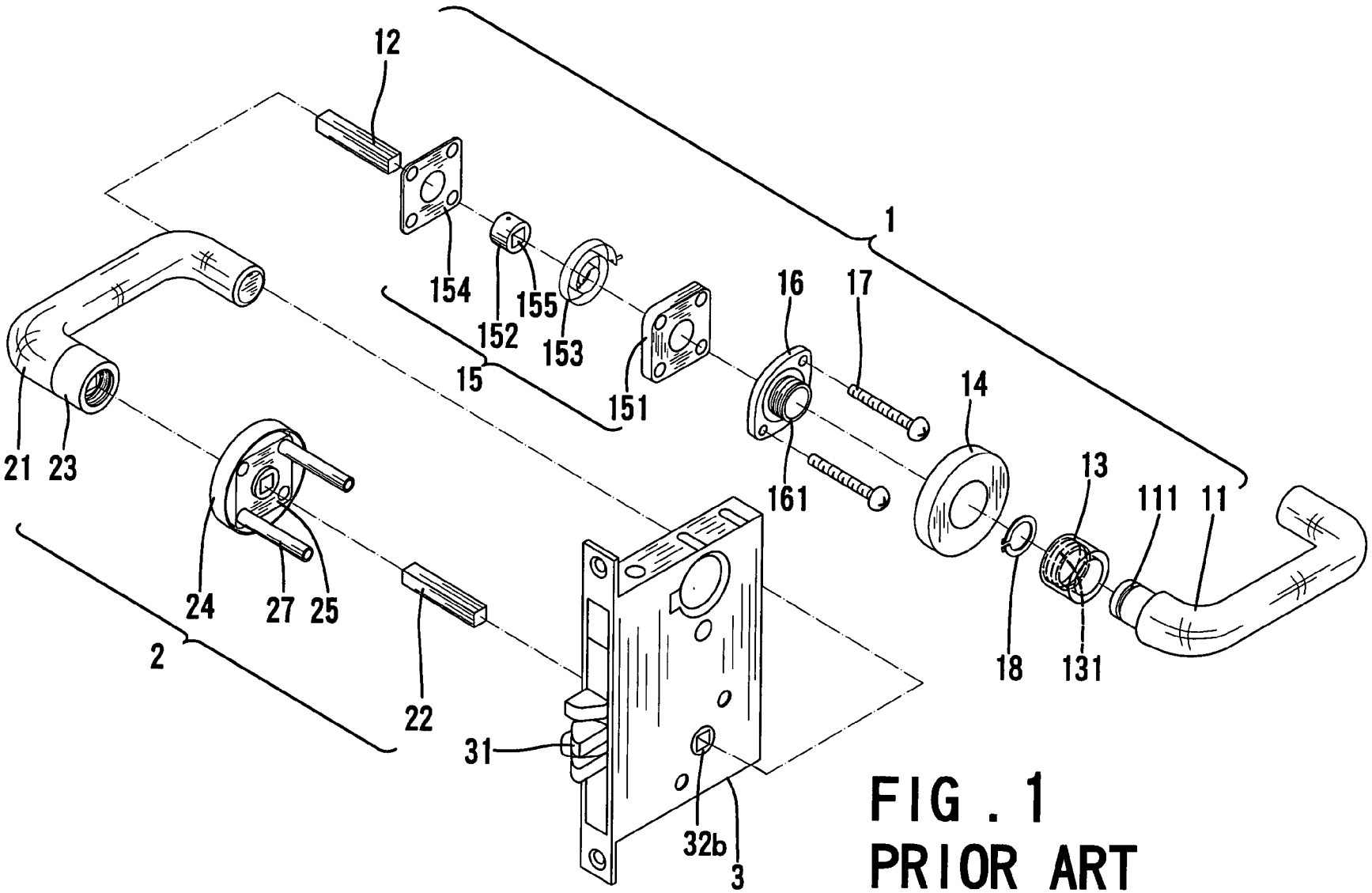
FIG. 1 PRIOR ART
FIG. 1 is an exploded perspective view of a conventional mortise lock.
Figure 2:
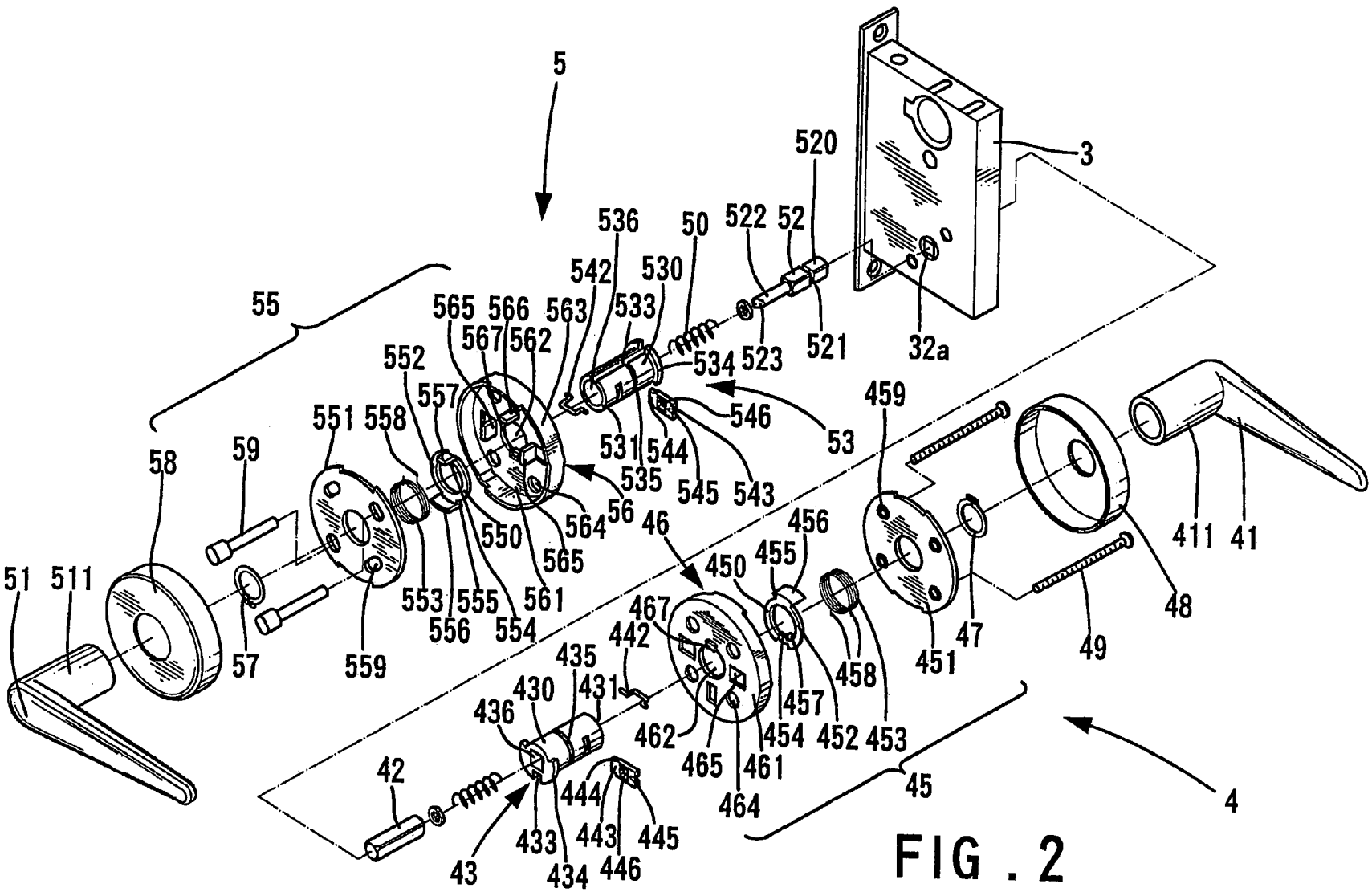
FIG. 2 is an exploded perspective view of a mortise lock in accordance with the present invention.

Referring to FIG. 2, a mortise lock in accordance with the present invention comprises an inside handle assembly 4, an outside handle assembly 5, and a chassis 3 between the inside handle assembly 4 and the outside handle assembly 5. The chassis 3 is mounted in a mounting hole 61 of a door 6 (e.g., a right handed door) and includes a plurality of bolts (see bolts 31 in FIG. 1), a mechanism for operating the bolts, and two spindle hubs 32*a* and 32*b*, which are conventional and thus not described in detail.

The inside handle assembly 4 includes an inside spindle 42 having an end received in the spindle hub 32*b* of the chassis 3 and an inside handle 41 connected to the inside spindle 42 to turn therewith. The outside handle assembly 5 includes an outside spindle 52 having an end received in the spindle hub 32*a* of the chassis 3 and an outside handle 51 connected to the outside spindle 52 to turn therewith. When either handle 41, 51 is turned, the associated spindle 42, 52 and the associated spindle hub 32*a*, 32*b* of the chassis 3 are turned to retract the bolts.

Figure 3:
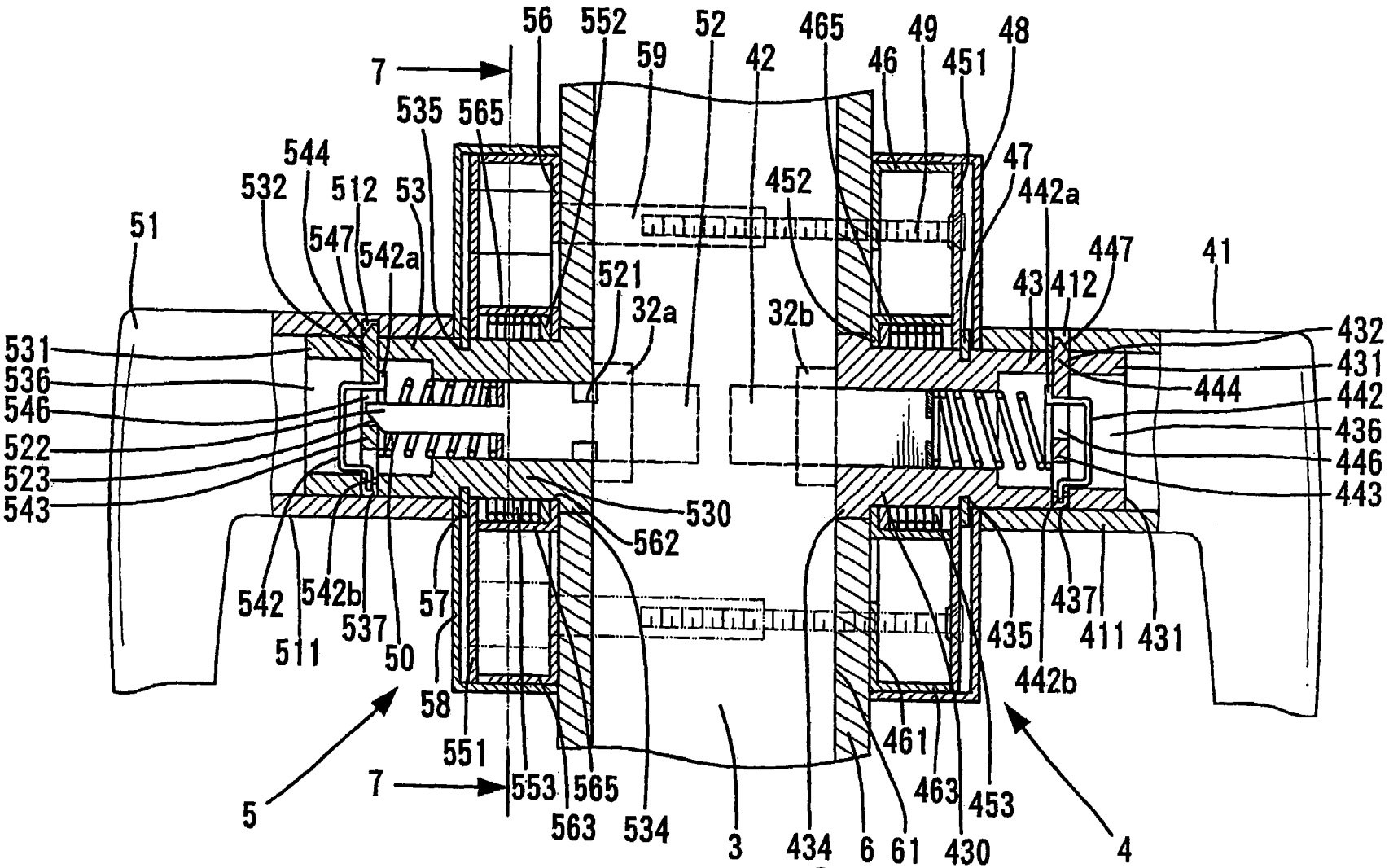
FIG. 3 is a side view, partly sectioned, of the mortise lock in accordance with the present invention and a door.

The outside handle 51 includes an end 511 to which an outside sleeve 53 is mounted. The outside sleeve 53 includes a first end 530 and a second end 531. Two stops 534 extend radially outward from the first end 530 of the outside sleeve 53. A longitudinal groove 533 is defined in an outer periphery of the outside sleeve 53. Also defined in the outer periphery of the outside sleeve 53 is an annular groove 535 into which a retainer ring 57 (FIGS. 3 and 5) is mounted. The outside sleeve 53 further includes a slot 532 communicated with a longitudinal hole 536 of the outside sleeve 53 and spaced from the annular groove 535. The outside sleeve 53 further includes a tenon 543 and a resilient member 542 mounted therein. The tenon 543 includes a first end 544 and a second end in which a notch 545 is defined. As illustrated in FIG. 3, the first end 544 of the tenon 543 is extended through the slot 532 of the outside sleeve 53 into an engaging hole 512 in the end 511 of the outside handle 51, thereby positioning the outside sleeve 53. Preferably, the first end 544 of the tenon 543 has an inclined face 547 to assist in mounting of the outside handle 51. The resilient member 542 is substantially U-shaped and has two L-shaped legs 542*a* and 542*b*. The L-shaped leg 542*a* presses against an end edge delimiting an opening 546 of the tenon 543, and the other L-shaped leg 542*b* extends through the notch 545 of the tenon 543 into a positioning hole 537 of the outside sleeve 53. Thus, the first end 544 of the tenon 543 is biased by the resilient member 542 into the engaging hole 512 of the outside handle 51.

An outside trim 55 is mounted around the first end 530 of the outside sleeve 53 for returning the outside handle 51 to its original position when the outside handle 51 is turned and then released. The outside trim 55 includes a spring seat 56, a ring 552 received in the spring seat 56, a spring 553 mounted on a side of the ring 552, and a lid 551 for closing the spring seat 56. The spring seat 56 includes a plate 561 with a central hole 562 and a cylindrical wall 563 extending from a periphery of the plate 561. Two pairs of diametrically disposed through-holes 564 are defined in the plate 561 and a pair of diametrically disposed lugs 565 are formed on a side of the plate 561. Also formed on the side of the plate 561 is a tab 566 angularly spaced from each lug 565 by 90 degrees. A protrusion 567 is formed on the other side of the plate 561 and located at an inner periphery delimiting the central hole 562. Preferably, the protrusion 567 is diametrically opposed to the tab 566.

The ring 552 received in the spring seat 56 includes a circular body 550 that is received in a space delimited by the lugs 565 and the tab 566. A protrusion 554 is formed on an inner periphery delimiting a central hole of the body 550 and engaged in the longitudinal groove 533 of the outside sleeve 53. Formed on an outer periphery of the body 550 and diametrically opposed to the protrusion 554 is a toothed-like stop 555. Two diametrically disposed legs 556 and 557 are formed on a side of the body 550 and extend in a direction parallel to a longitudinal direction of the outside spindle 52. Preferably, the annular positions of the legs 556 and 557 correspond to those of the stop 555 and the protrusion 554. Preferably, each leg 556, 557 has a length the same as that of the cylindrical wall 563 of the spring seat 56.

The lid 551 includes two pairs of diametrically disposed holes 559. The number of the holes 559 corresponds to that of the through-holes 564 of the spring seat 56. The outside sleeve 53 extends through a central hole (not labeled) of the lid 551, the central hole of the ring 552, and the central hole 562 of the spring seat 56, as shown in FIG. 3. Two posts 59 are extended through a pair of holes 559 of the lid 551 and a pair of through-holes 564 of the spring seat 56 into the chassis 3, as shown in FIG. 3.

Figure 4:
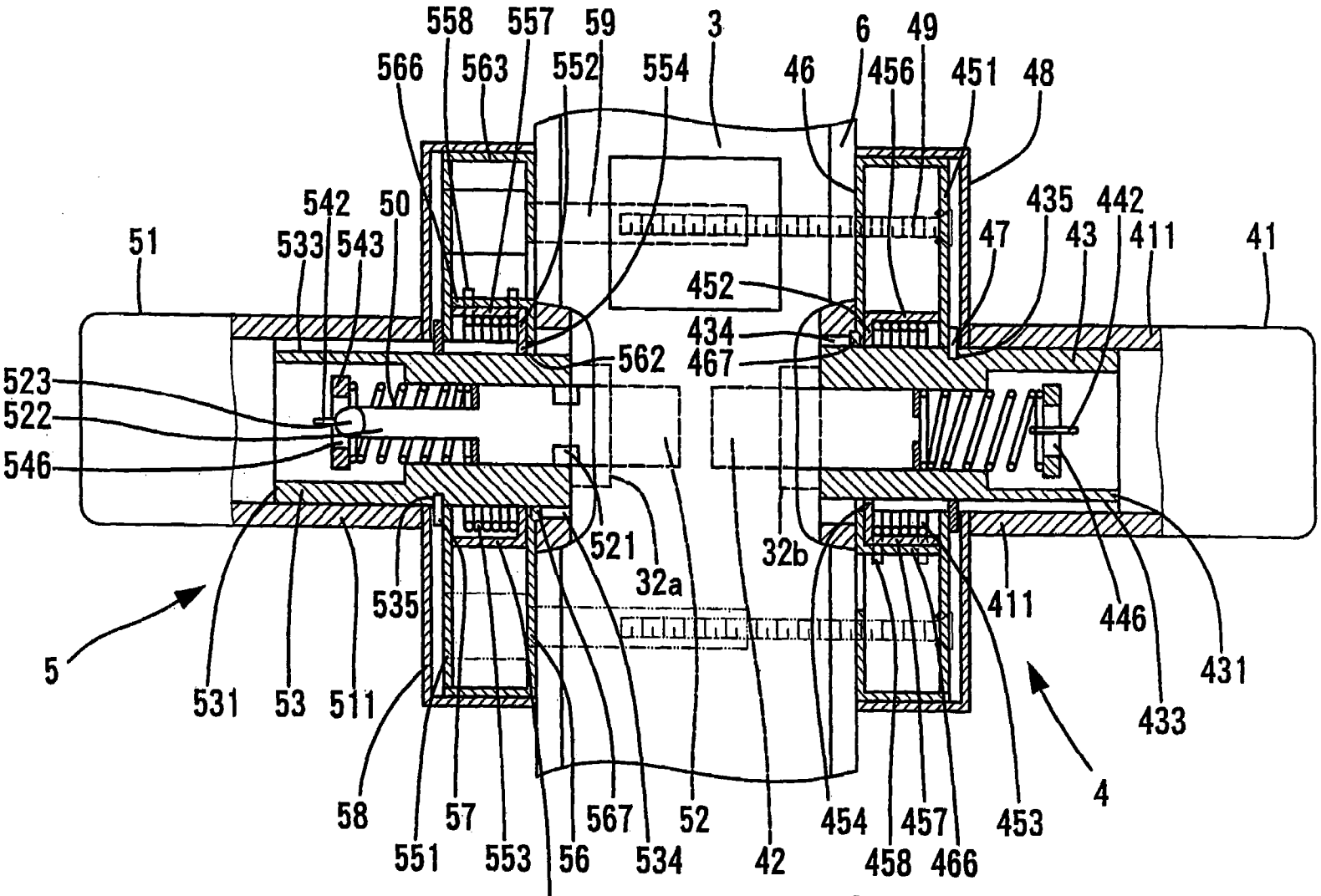
FIG. 4 is a sectional view similar to FIG. 3, wherein the handles of the mortise lock are turned.
Figure 5:
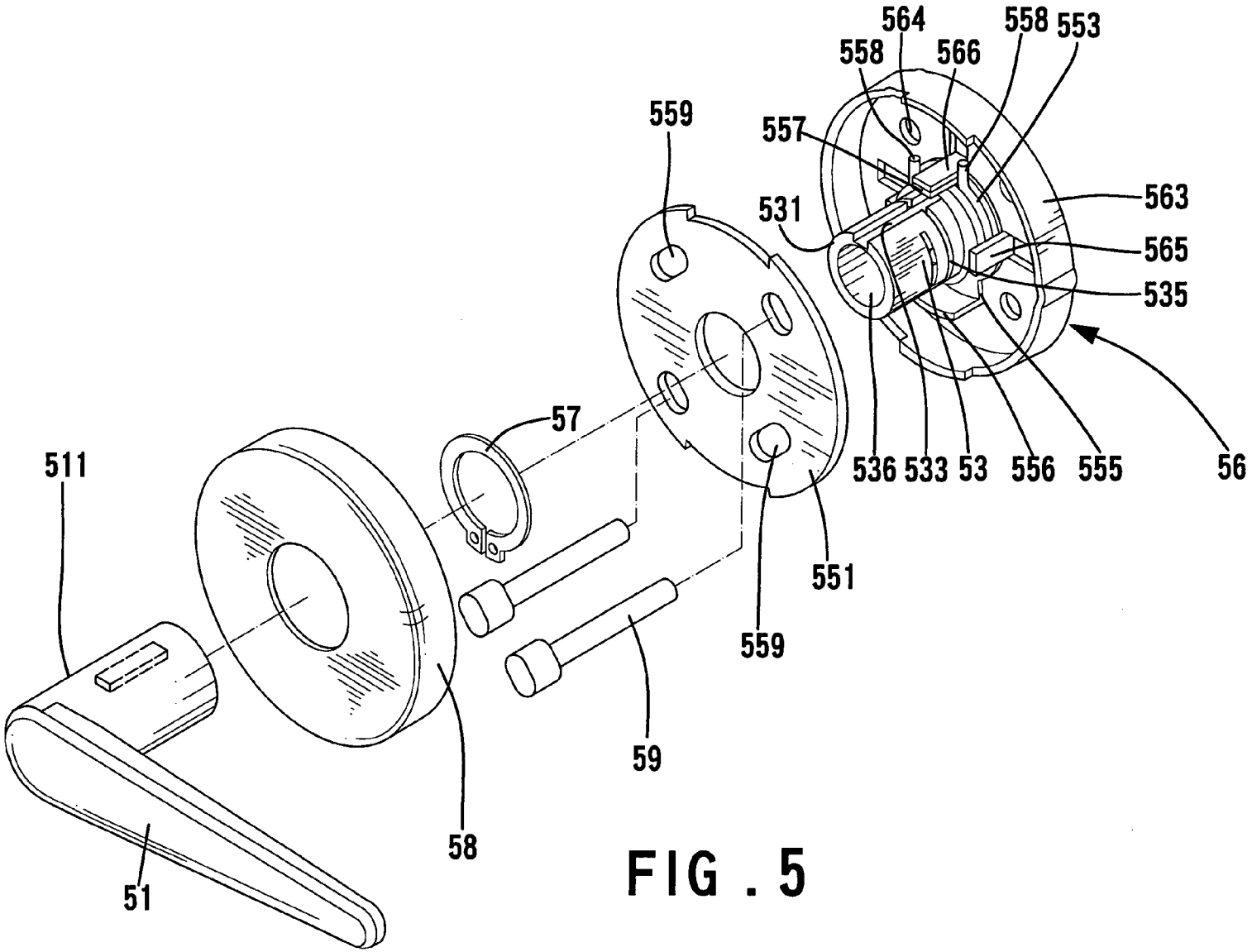
FIG. 5 is an exploded perspective view of an outside handle assembly of the mortise lock in accordance with the present invention.
Figure 6:
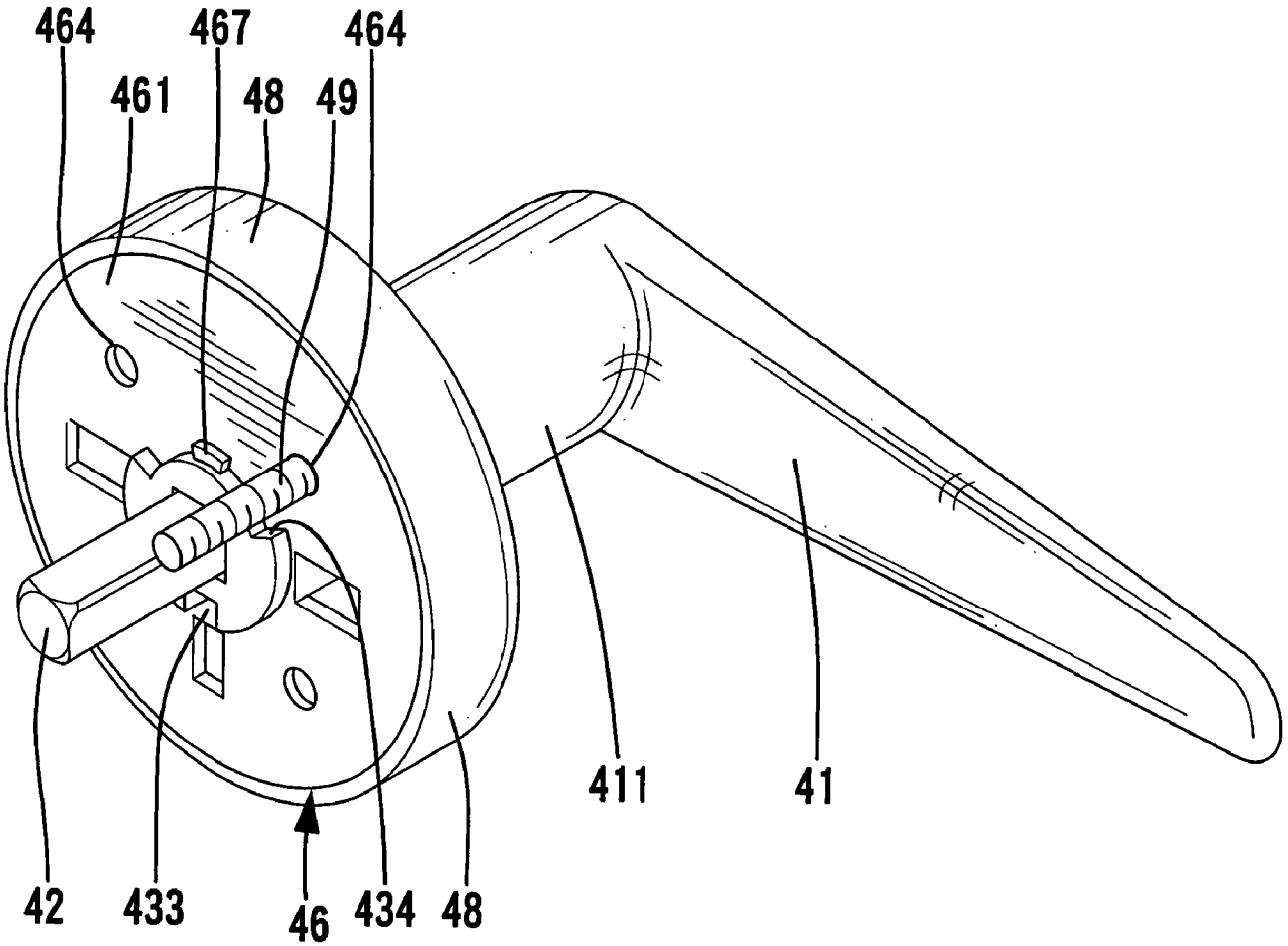
FIG. 6 is a perspective view of an inside handle assembly of the mortise lock in accordance with the present invention.

As illustrated in FIGS. 4 and 5, the leg 557 of the ring 552 is in intimate contact with an inner face of the tab 566 of the spring seat 56. Two ends 558 of the spring 553 received in the ring 552 respectively press against a side of the leg 557 of the ring 552 and the other side of the leg 557 of the ring 552. The retainer ring 57 is partially received in the annular groove 535 of the outside sleeve 53 and sandwiched between the lid 551 and an outside rose 58. The outside rose 58 is mounted around the outside sleeve 53 and sandwiched between the lid 551 and an end face of the end 511 of the outside handle 51, best shown in FIG. 3.

Referring to FIGS. 2, 3, 4, and 6, the inside handle 41 includes an end 411 to which an inside sleeve 43 is mounted. The inside sleeve 43 includes a first end 430 and a second end 431. Two stops 434 extend radially outward from the first end 430 of the inside sleeve 43. A longitudinal groove 433 is defined in an outer periphery of the inside sleeve 43. Also defined in the outer periphery of the inside sleeve 43 is an annular groove 435 into which a retainer ring 47 is mounted. The inside sleeve 43 further includes a slot 432 communicated with a longitudinal hole 436 of the inside sleeve 43 and spaced from the annular groove 435. The inside sleeve 43 further includes a tenon 443 and a resilient member 442 mounted therein. The tenon 443 includes a first end 444 and a second end in which a notch 445 is defined. As illustrated in FIG. 3, the first end 444 of the tenon 443 is extended through the slot 432 of the inside sleeve 43 into an engaging hole 412 in the end 411 of the inside handle 41, thereby positioning the inside sleeve 43. Preferably, the first end 444 of the tenon 443 has an inclined face 447. The resilient member 442 is substantially U-shaped and has two L-shaped legs 442*a* and 442*b*. The L-shaped leg 442*a* presses against an end edge delimiting an opening 446 of the tenon 443, and the other L-shaped leg 442*b* extends through the notch 445 of the tenon 443 into a positioning hole 437 of the outside sleeve 430. Thus, the first end 444 of the tenon 443 is biased by the resilient member 442 into the engaging hole 412 of the inside handle 41.

An inside trim 45 is mounted around the first end 430 of the inside sleeve 43 for returning the outside handle 41 to its original position when the inside handle 41 is turned and then released. The inside trim 45 includes a spring seat 46, a ring 452 received in the spring seat 46, a spring 453 mounted on a side of the ring 452, and a lid 451 for closing the spring seat 46. The spring seat 46 includes a plate 461 with a central hole 462 and a cylindrical wall 463 extending from a periphery of the plate 461. Two pairs of diametrically disposed through-holes 464 are defined in the plate 461 and a pair of diametrically disposed lugs 465 are formed on a side of the plate 461. Also formed on the side of the plate 461 is a tab 466 angularly spaced from each lug 465 by 90 degrees. A protrusion 467 is formed on the other side of the plate 461 and located at an inner periphery delimiting the central hole 462. Preferably, the protrusion 467 is diametrically opposed to the tab 466.

The ring 452 received in the spring seat 46 includes a circular body 450 that is received in a space delimited by the lugs 465 and the tab 466. A protrusion 454 is formed on an inner periphery delimiting a central hole of the body 450 and engaged in the longitudinal groove 433 of the outside sleeve 43. Formed on an outer periphery of the body 450 and diametrically opposed to the protrusion 454 is a toothed-like stop 455. Two diametrically disposed legs 456 and 457 are formed on a side of the body 450 and extend in a direction parallel to a longitudinal direction of the inside spindle 42. Preferably, the annular positions of the legs 456 and 457 correspond to those of the stop 455 and the protrusion 454. Preferably, each leg 456, 457 has a length the same as that of the cylindrical wall 463 of the spring seat 46.

The lid 451 includes two pairs of diametrically disposed holes 459. The number of the holes 459 corresponds to that of the through-holes 464 of the spring seat 46. The outside sleeve 43 extends through a central hole (not labeled) of the lid 451, the central hole of the ring 452, and the central hole 462 of the spring seat 46, as shown in FIG. 3. Two screws 49 are extended through a pair of holes 459 of the lid 451 and a pair of through-holes 464 of the spring seat 46 into screw holes (not labeled) in the posts 59.

The leg 457 of the ring 452 is in intimate contact with an inner face of the tab 466 of the spring seat 46. Two ends 458 of the spring 453 received in the ring 452 respectively press against a side of the leg 457 of the ring 452 and the other side of the leg 457 of the ring 452. The retainer ring 47 is partially received in the annular groove 435 of the inside sleeve 43 and sandwiched between the lid 451 and an inside rose 48. The inside rose 48 is mounted around the inside sleeve 43 and sandwiched between the lid 451 and an end face of the end 411 of the inside handle 41, best shown in FIG. 3.

Figure 7:
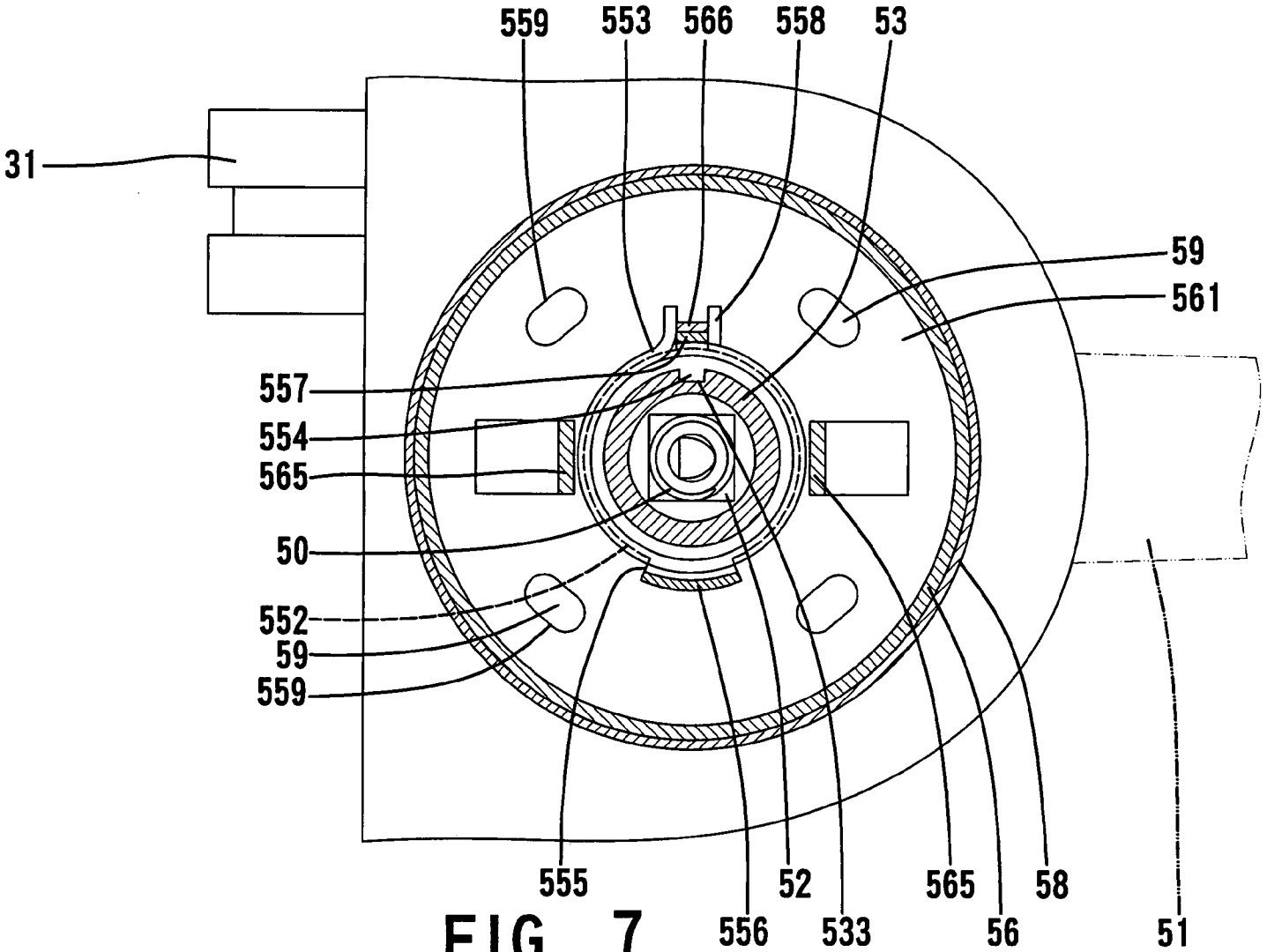
FIG. 7 is a sectional view taken along plane 7—7 in FIG. 3.
Figure 8:
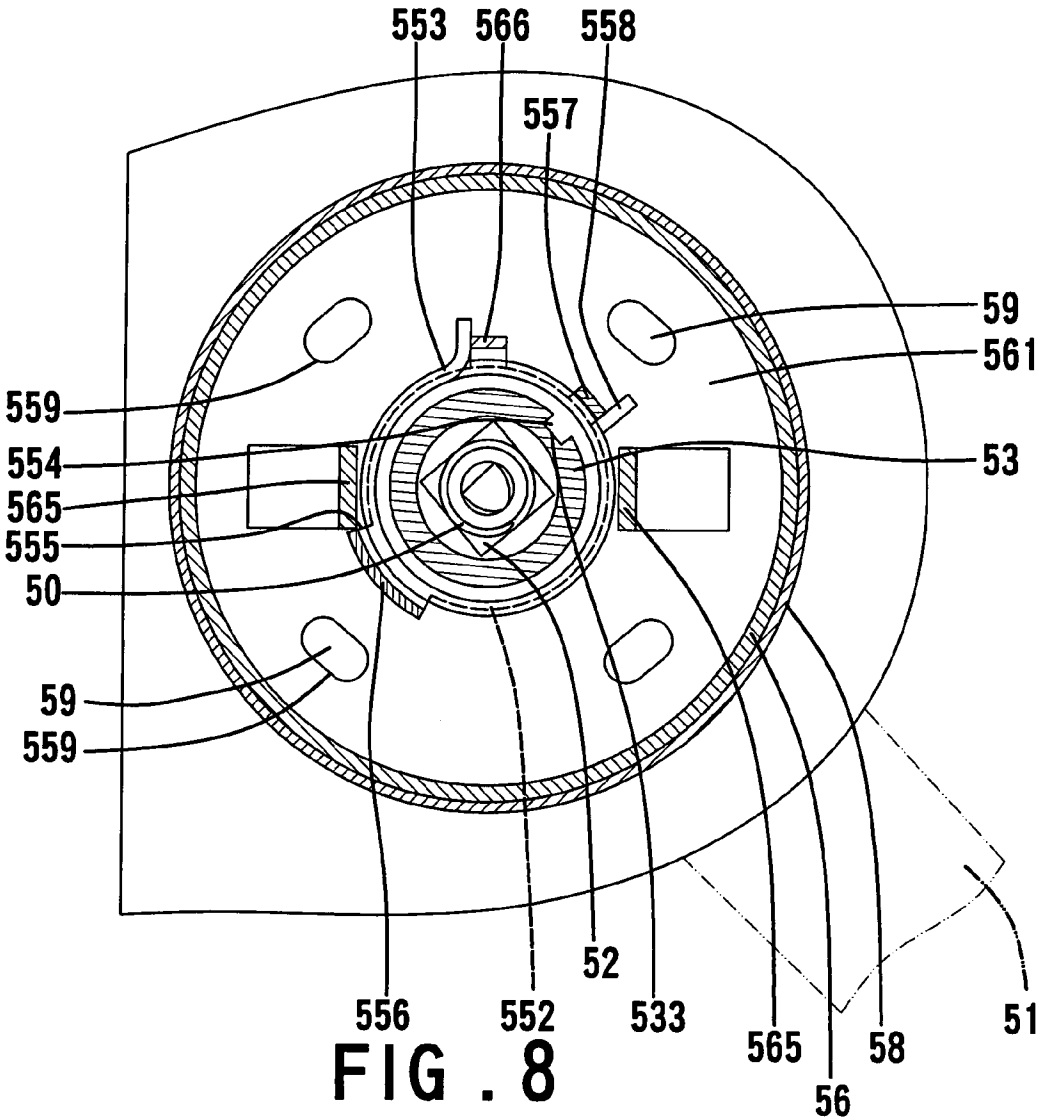
FIG. 8 is a view similar to FIG. 7, wherein an outside handle of the mortise lock is turned.
Figure 9:
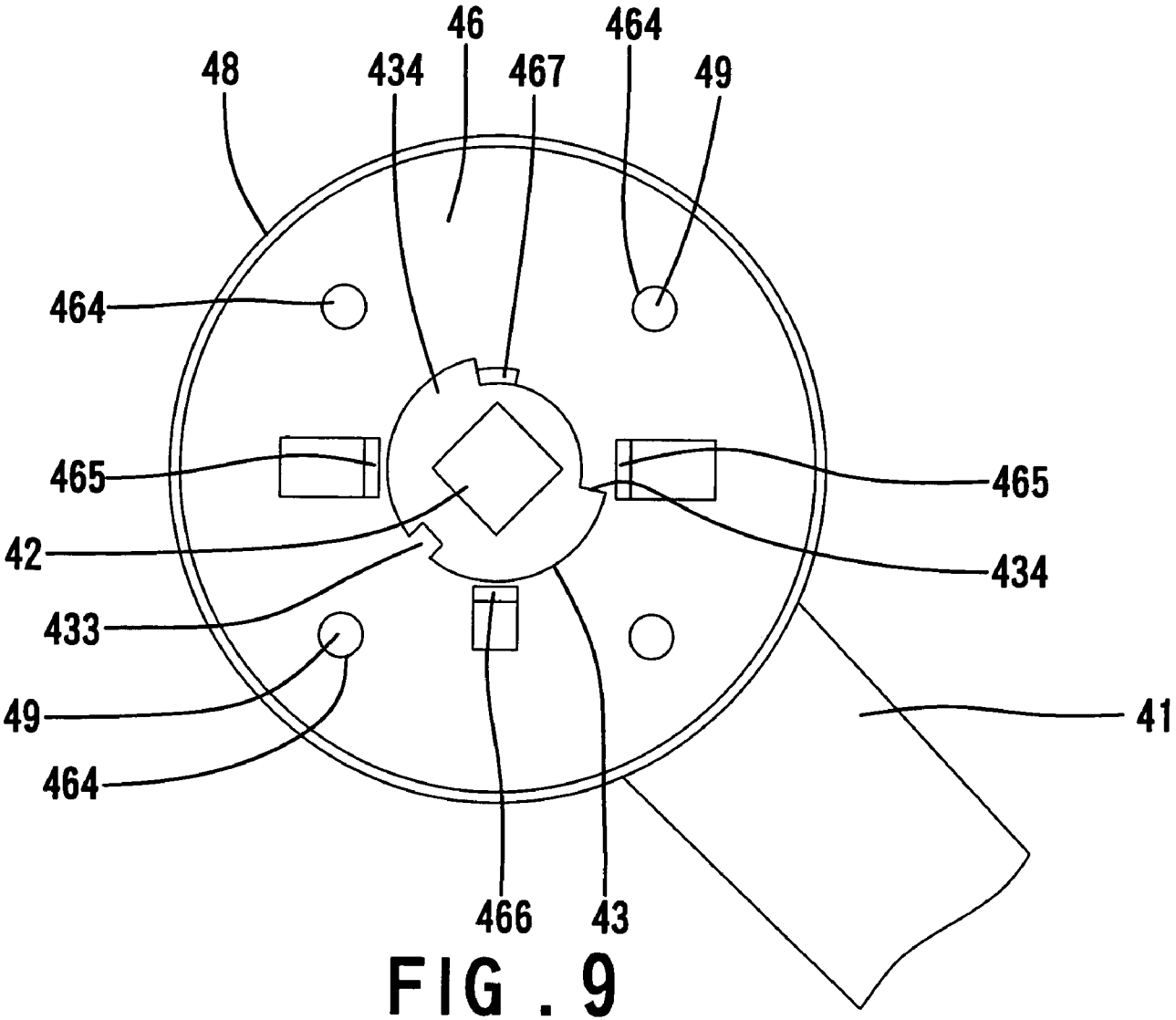
FIG. 9 is a view illustrating turning of an inside handle of the mortise lock in accordance with the present invention.

Referring to FIGS. 7 and 8, when either handle 41, 51 is turned (e.g., the outside handle 51), the outside spindle 52 is also turned, with the ring 552 being turned by the outside sleeve 53. The leg 557 of the ring 552 presses against an end 558 of the spring 553 to store energy for returning the ring 552 and the outside spindle 53. When the outside handle 51 is turned and then released, the outside handle 51 is returned to its original position under the action of the spring 553.

When the outside handle 51 is turned through an angle sufficient to retract the bolts 31 of the chassis 3, the stop 555 of the ring 552 is stopped by one of the lugs 565 of the spring seat 56 and one of the stops 534 is moved to a position pressing against and thus stopped by the protrusion 567 of the spring seat 56, preventing further rotational movement of the outside spindle 52 and the outside handle 51. Similarly, when the inside handle 41 is turned through an angle sufficient to retract the bolts 31 of the chassis 3, the stop 455 of the ring 452 is stopped by one of the lugs 465 of the spring seat 46 and one of the stops 434 is moved to a position pressing against and thus stopped by the protrusion 467 of the spring seat 46, preventing further rotational movement of the inside spindle 42 and the inside handle 41. Thus, excessive torque resulting from excessive turning of the inside handle 41 or the outside handle 51 is avoided, preventing damage to the elements of the mortise lock. Even if an excessive force is applied to either handle 41, 51, the impact would not be transmitted to the bolt-operating mechanism in the chassis 3. The life of the mortise lock is prolonged.

Installation of the sleeve 43, 53 into the associated handle 41, 51 is simpler as compared to the conventional mortise lock, as no special tool is required. Troublesome processing of the sleeves 13 and 23 of the conventional mortise lock is avoided. Further, the cost of the handles 41 and 51 can be cut, as they can be made of zinc instead of brass. Further, the cost for processing the inner threading 131 in the sleeve 13, 23 and for processing the threading section 111 for the handle 11, 21 of the conventional design can be saved.

In a case that an excessive force (greater than a threshold force) is applied to the outside handle 51 for the purpose of destroying the mortise lock, the resultant torque would be large enough to cause breakage of the outside spindle 52 at the fragile portion 521. Thus, unauthorized opening of the door by forcibly turning the outside handle 51 is prevented. Also, damage to the inner mechanism of the mortise lock is prevented.

The mortise lock in accordance with the present invention illustrated in FIGS. 1 through 9 is used on, e.g., a right-handed door. Nevertheless, the mortise lock in accordance with the present invention can also be used on a left-handed door.

Figure 10:
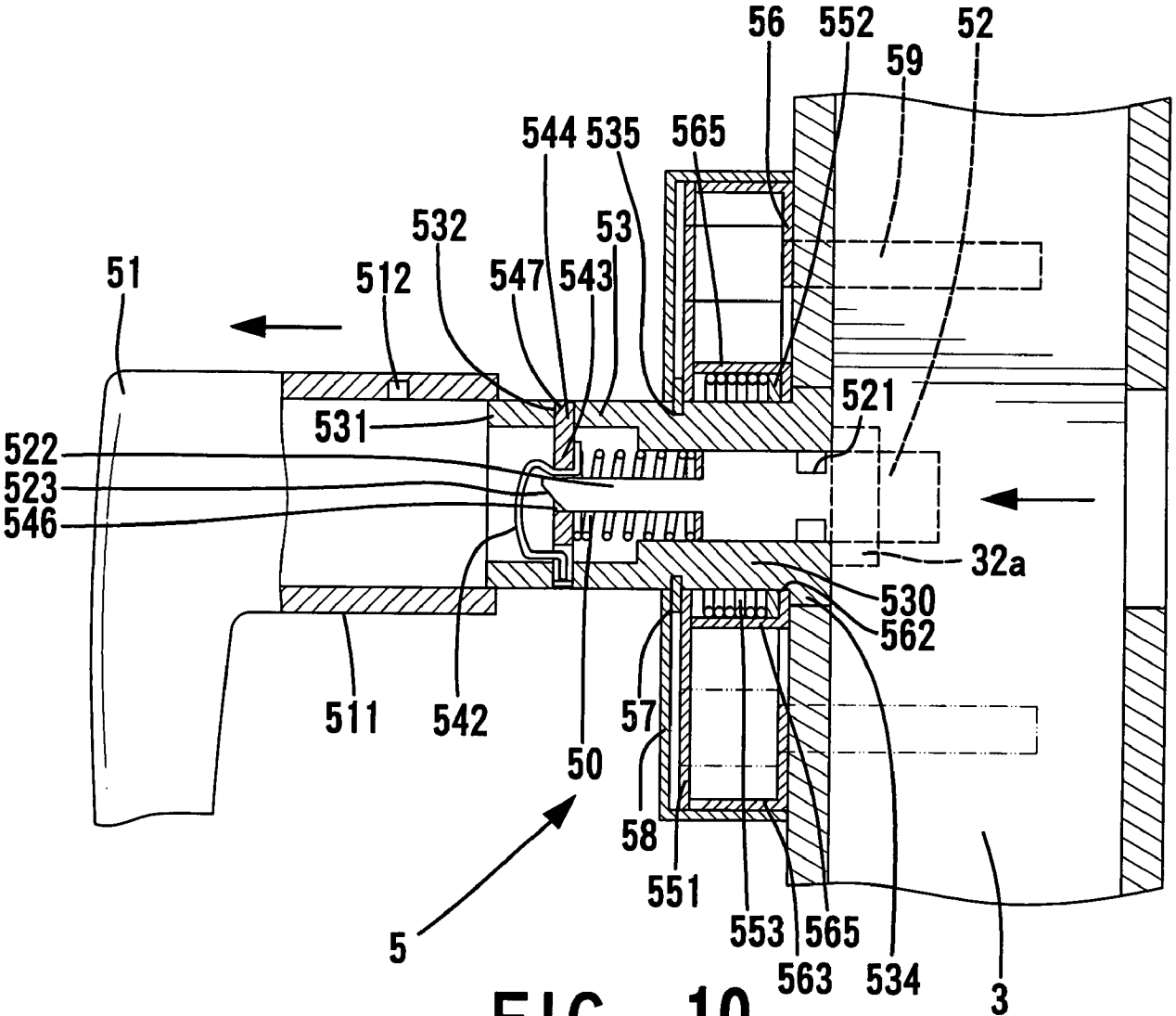
FIG. 10 is a view illustrating disengagement of the outside handle of the mortise lock in accordance with the present invention.
Figure 11:
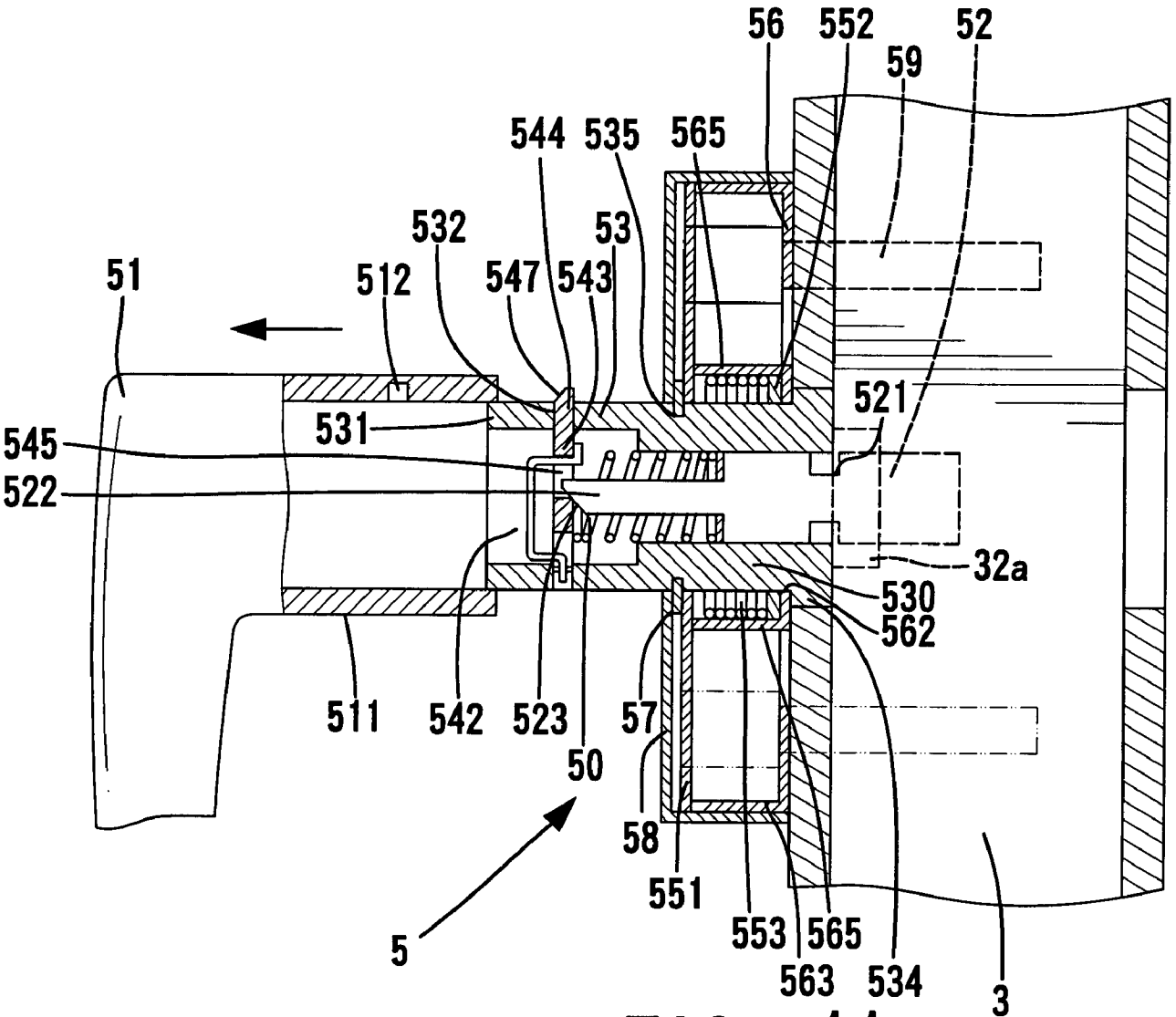
FIG. 11 is a view similar to FIG. 10, illustrating movement of a tenon of the outside handle assembly.

In a case that the installer found that the handles 41 and 51 were installed in the wrong handing, this mistake can be simply solved. Referring to FIG. 10, the inside handle assembly 4 is firstly detached, and the outside handle 51 can be detached by pushing the outside spindle 52 outward for the purposes of changing the handing of the inside spindle 42 and the outside spindle 52 to match the orientation of the door (i.e., a left-handed one or a right-handed one), which is convenient to the installer. In particular, when the outside spindle 52 is pushed outward, the inclined surface 523 of the outside spindle 52 presses against and slides across an end edge delimiting the opening 546 of the tenon 543, causing the first end 544 of the tenon 543 to disengage from the engaging hole 512 of the outside handle 51 and compressing the resilient member 542. The outside handle 51 can be removed (see FIG. 11) and the outside rose 58 and the outside trim 55 can be then removed. When the force pushing the outside spindle 52 outward is turned and then, the outside spindle 52 is returned to its original position shown in FIG. 11 under the action of a spring 50 mounted around the reduced second end 522 of the outside spindle 52. An end of the spring 50 abuts against the tenon 543, and the other end of the spring 50 abuts against the first end 520 of the outside spindle 52. The first end 544 of the tenon 543 is moved to a position beyond the slot 532 of the outside sleeve 53 under the action of the resilient member 542.

Figure 12:
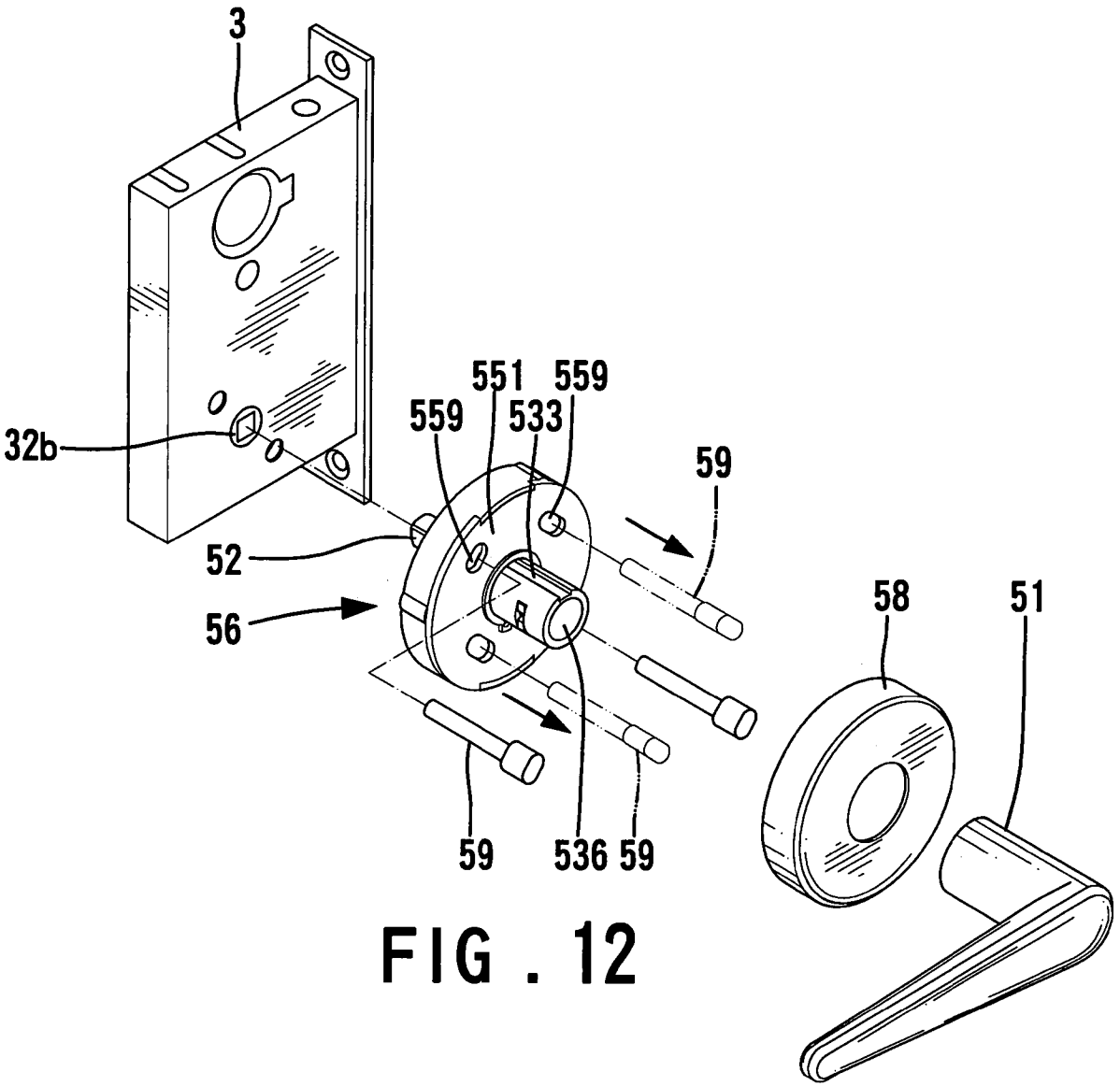
FIG. 12 is an exploded perspective view illustrating detachment of two posts and remounting of the posts and the outside handle.
Figure 13:
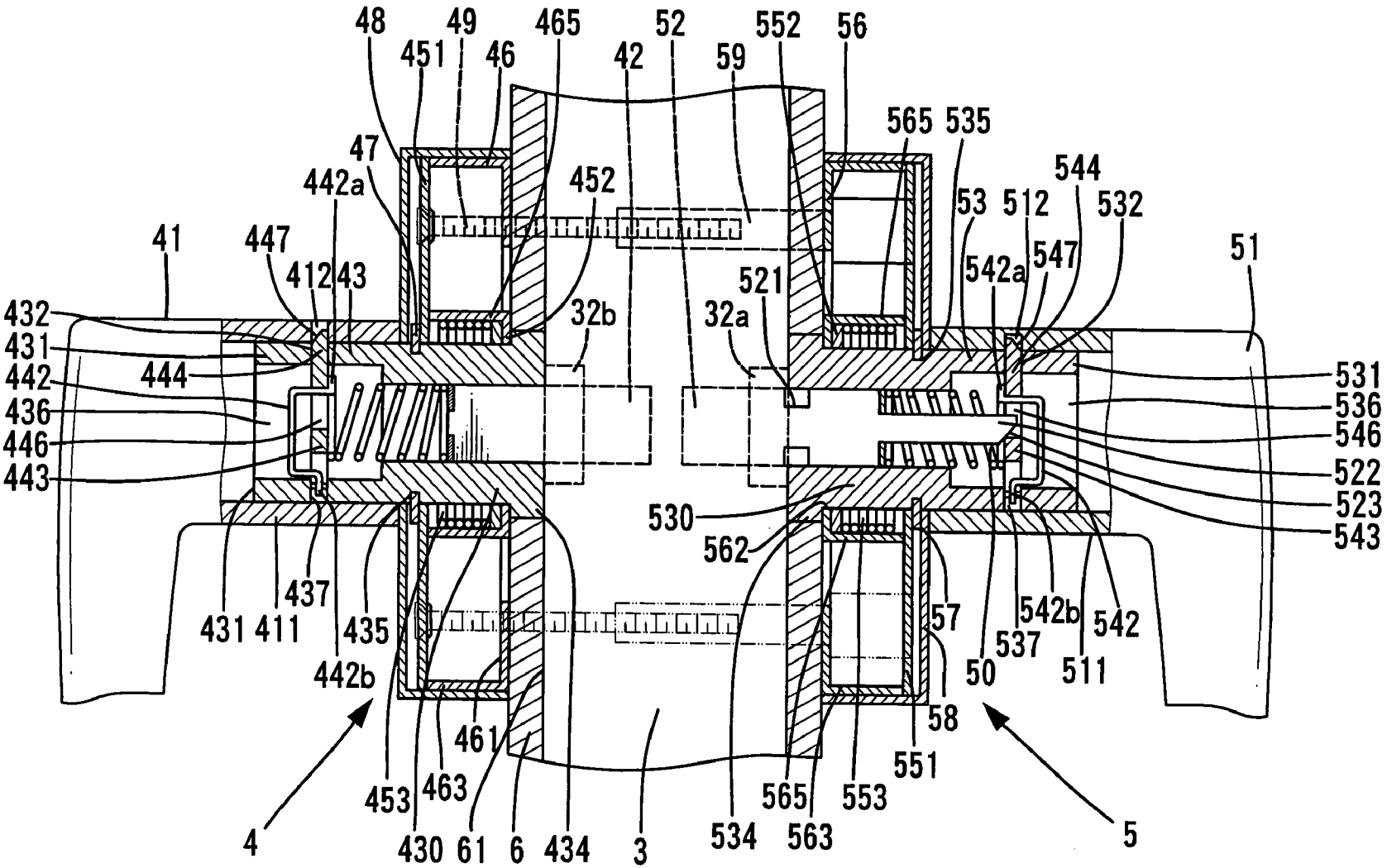
FIG. 13 is a sectional view similar to FIG. 3, illustrating use of the mortise lock in accordance with the present invention with an oppositely handed door.

Referring to FIG. 12, the posts 59 are detached from the pair of holes 559 of the lid 551 to allow removal of the outside trim 55. Referring to FIG. 13, the outside handle assembly 5 and the outside trim 55 are mounted to the other side of the door 6, and the inside handle assembly 4 and the inside trim 45 are mounted to the other side of the door 6, with the posts 59 being extended through the other pair of holes 559 of the lid 551 (see FIG. 12). The inclined face 547 of the tenon 543 and the inclined face 447 of the tenon 443 assist in mounting of the handles 41 and 51. Thus, the mortise lock in accordance with the present invention can be used with both left-handed doors and right-handle doors (compare FIG. 13 with FIG. 3) by easy adjustment of the mortise lock.

Although the invention has been explained in relation to its preferred embodiment, it is to be understood that many other possible modifications and variations can be made without departing from the scope of the invention as hereinafter claimed.

What is claimed is:

1. A mortise lock comprising:

a chassis adapted to be mounted in a mounting hole of a door, the chassis including at least one bolt; and an outside handle assembly mounted to a side of the chassis, the outside handle assembly including:

an outside spindle including a first end partially received in the chassis and operably connected to said at least one bolt such that rotation of the outside spindle causes retraction of said at least one bolt, the outside spindle further including a second end, the first end of the outside spindle including a perimeter groove, forming a fragile portion;

an outside handle including an end securely connected to the second end of the outside spindle to turn therewith;

the fragile portion of the outside spindle being broken when an excessive force is applied to the outside handle;

the outside handle assembly further comprising an outside sleeve including a first end and a second end, the first end of the outside sleeve being securely mounted around a portion of the first end of the outside spindle to turn therewith, the second end of the outside sleeve receiving the second end of the outside spindle and being securely connected to the end of the outside handle; and the end of the outside handle including an engaging hole, the outside sleeve including a longitudinal hole and a longitudinal groove defined in an outer periphery thereof, the outside sleeve further including a positioning hole and a slot in the outer periphery of the outside sleeve, the slot being communicated with the longitudinal hole and aligned with the engaging hole of the outside handle, a tenon being mounted in outside sleeve and including a first end received in the slot of the outside sleeve and a second end having a notch, the tenon further including an opening, a resilient member being substantially U-shaped and mounted in the outside sleeve, the resilient member including a first L-shaped leg pressing against an end edge delimiting the opening of the tenon, the resilient member further including a second L-shaped leg extending through the notch of the tenon into the positioning hole of the outside sleeve, the resilient member biasing the first end of the tenon into the engaging hole of the outside handle.

2. The mortise lock as claimed in claim 1, further comprising an inside handle assembly mounted to another side of the chassis, the inside handle assembly including:

an inside spindle including a first end partially received in the chassis and operably connected to said at least one bolt such that rotation of the inside spindle causes retraction of said at least one bolt, the inside spindle further including a second end; and an inside handle including an end securely connected to the second end of the inside spindle to turn therewith.

3. The mortise lock as claimed in claim 1, further comprising means for returning the outside handle to an original position when the outside handle is turned and then released.

4. The mortise lock as claimed in claim 2, further comprising means for returning the inside handle to an original position when the inside handle is turned and then released.

5. The mortise lock as claimed in claim 1, with the first end of the tenon including an inclined face.

6. The mortise lock as claimed in claim 1, with the second end of the outside spindle having an inclined surface pressing against an edge delimiting the opening of the tenon;

wherein when the outside spindle is pushed outward, the first end of the tenon is disengaged from the engaging hole of the outside handle, allowing removal of the outside handle from the outside sleeve.

7. The mortise lock as claimed in claim 1, further including an outside trim for returning the outside handle to an original position when the outside handle is turned and then released, the outside trim comprising:

a spring seat including a plate mounted around the first end of the outside sleeve and a cylindrical wall extending from a periphery of the plate;

a ring received in the spring seat, the ring including a body having a central hole and mounted around the first end of the outside sleeve, the ring further including two spaced legs and formed on a side of the body and extending in a direction parallel to a longitudinal direction of the outside spindle, a protrusion being formed on an inner periphery delimiting the central hole of the body, the protrusion being engaged in the longitudinal groove of the outside sleeve;

a spring mounted on a side of the ring, the spring including a first end abutting against a side of one of the legs of the ring and a second end abutting against another side of said one of the legs of the ring; and a lid for closing the spring seat.

8. The mortise lock as claimed in claim 7, with the plate including two pairs of through-holes, the lid including two pairs of holes aligned with the through-holes of the plate, with two posts extending through two of the holes of the lid and two of the through-holes of the plate.

9. The mortise lock as claimed in claim 6, with a spring being mounted around the second end of the outside spindle for biasing the inclined surface of the outside spindle to press against the end edge delimiting the opening of the tenon.

10. The mortise lock as claimed in claim 8, with the body of the ring further including a stop on an outer periphery thereof, with the first end of the outside sleeve including two stops, with the plate including a protrusion and two diametrically disposed lugs, wherein when the outside handle is turned through an angle sufficient to retract said at least one bolt of the chassis, the stop of the ring is stopped by one of the lugs of the spring seat and one of the stops of the outside sleeve is stopped by the protrusion of the spring seat, preventing further rotational movement of the outside spindle and the outside handle.

11. The mortise lock as claimed in claim 2, further comprising an inside sleeve including a first end and a second end, the first end of the inside sleeve being securely mounted around a portion of the first end of the inside spindle to turn therewith, the second end of the inside sleeve receiving the second end of the inside spindle and being securely connected to the end of the inside handle.

12. A mortise lock comprising:

a chassis adapted to be mounted in a mounting hole of a door, the chassis including at least one bolt; and an outside handle assembly mounted to a side of the chassis, the outside handle assembly including:

an outside spindle including a first end partially received in the chassis and operably connected to said at least one bolt such that rotation of the outside spindle causes retraction of said at least one bolt, the outside spindle further including a second end, the first end of the outside spindle including a perimeter groove, forming a fragile portion;

an outside handle including an end securely connected to the second end of the outside spindle to turn therewith;

the fragile portion of the outside spindle being broken when an excessive force is applied to the outside handle;

an inside handle assembly mounted to another side of the chassis, the inside handle assembly including: an inside spindle including a first end partially received in the chassis and operably connected to said at least one bolt such that rotation of the inside spindle causes retraction of said at least one bolt, the inside spindle further including a second end; and an inside handle including an end securely connected to the second end of the inside spindle to turn therewith;

further comprising an inside sleeve including a first end and a second end, the first end of the inside sleeve being securely mounted around a portion of the first end of the inside spindle to turn therewith, the second end of the inside sleeve receiving the second end of the inside spindle and being securely connected to the end of the inside handle:

the end of the inside handle including an engaging hole, the inside sleeve including a longitudinal hole and a longitudinal groove defined in an outer periphery thereof, the inside sleeve further including a positioning hole and a slot in the outer periphery of the inside sleeve, the slot being communicated with the longitudinal hole and aligned with the engaging hole of the inside handle, a tenon being mounted in inside sleeve and including a first end received in the slot of the inside sleeve and a second end having a notch, the tenon further including an opening, a resilient member being substantially U-shaped and mounted in the inside sleeve, the resilient member including a first L-shaped leg pressing against an end edge delimiting the opening of the tenon, the resilient member further including a second L-shaped leg extending through the notch of the tenon into the positioning hole of the inside sleeve, the resilient member biasing the first end of the tenon into the engaging hole of the inside handle.

13. The mortise lock as claimed in claim 12, with the first end of the tenon including an inclined face.

14. The mortise lock as claimed in claim 12, further including an inside trim for returning the inside handle to an original position when the inside handle is turned and then released, the inside trim comprising:

a spring seat including a plate mounted around the first end of the inside sleeve and a cylindrical wall extending from a periphery of the plate;

a ring received in the spring seat, the ring including a body having a central hole and mounted around the first end of the inside sleeve, the ring further including two spaced legs formed on a side of the body and extending in a direction parallel to a longitudinal direction of the inside spindle, a protrusion is formed on an inner periphery delimiting the central hole of the body, the protrusion being engaged in the longitudinal groove of the outside sleeve;

a spring mounted on a side of the ring, the spring including a first end abutting against a side of one of the legs of the ring and a second end abutting against another side of said one of the legs of the ring; and a lid for closing the spring seat.

15. The mortise lock as claimed in claim 14, with the plate including two pairs of through-holes, the lid including two pairs of holes aligned with the through-holes of the plate, with two posts extending through two of the holes of the lid and two of the through-holes of the plate.

16. The mortise lock as claimed in claim 14, with the body of the ring further including a stop on an outer periphery thereof, with the first end of the inside sleeve including two stops, with the plate including a protrusion and two diametrically disposed lugs, wherein when the outside handle is turned through an angle sufficient to retract said at least one bolt of the chassis, the stop of the ring is stopped by one of the lugs of the spring seat and one of the stops of the inside sleeve is stopped by the protrusion of the spring seat, preventing further rotational movement of the inside spindle and the inside handle.

* * * * *